US006648618B2

(12) United States Patent
Nishiki et al.

(10) Patent No.: US 6,648,618 B2
(45) Date of Patent: Nov. 18, 2003

(54) SCROLL COMPRESSOR

(75) Inventors: Teruhiko Nishiki, Tokyo (JP); Takeshi Fushiki, Tokyo (JP); Kiyoharu Ikeda, Tokyo (JP); Yoshihide Ogawa, Tokyo (JP); Takashi Sebata, Tokyo (JP); Fumiaki Sano, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/055,903

(22) Filed: Jan. 28, 2002

(65) Prior Publication Data

US 2002/0102175 A1 Aug. 1, 2002

(30) Foreign Application Priority Data

Jan. 29, 2001 (JP) ..... 2001-020133

(51) Int. Cl.[7] ..... F04C 18/00
(52) U.S. Cl. ..... 418/55.5; 418/57
(58) Field of Search ..... 418/55.1, 55.5, 418/57

(56) References Cited

U.S. PATENT DOCUMENTS 6,135,739 A 10/2000 Ogawa et al.

FOREIGN PATENT DOCUMENTS

| | | | | |
|---|---|---|---|---|
| EP | 1 002 953 | | 5/2000 | |
| JP | 11-107938 | | 4/1999 | |
| JP | 2000-161254 | | 6/2000 | |
| JP | 2000-329075 | | 11/2000 | |
| JP | 2000337276 A | * | 12/2000 | ..... F04C/18/02 |
| JP | 2001-50180 | | 2/2001 | |
| JP | 2001-304147 | | 10/2001 | |
| WO | WO 95/12759 | | 5/1995 | |
| WO | 1042969 C | | 4/1999 | |

* cited by examiner

*Primary Examiner*—Thomas Denion
*Assistant Examiner*—Theresa Trieu
(74) *Attorney, Agent, or Firm*—Oblon, Spivak, McClelland, Maier & Neustadt, P.C.

(57) ABSTRACT

A structure is provided that prevents excessive force from acting on a fastening portion where a guide frame is fastened to a sealed container. A fastening position of the guide frame and sealed structure is set within a range bounded by an upper meshing circumferential inner surface of the guide frame together with an upper meshing circumferential outer surface of a compliant frame and a lower meshing circumferential inner surface of the guide frame together with a lower meshing circumferential outer surface of the compliant frame.

8 Claims, 4 Drawing Sheets

SCROLL COMPRESSOR

FIELD OF THE INVENTION

The present invention relates to a scroll compressor, which is a refrigerant compressor used in refrigeration air conditioning equipment.

BACKGROUND OF THE INVENTION

Conventionally, a scroll compressor such as that disclosed in Japanese Patent Application Laid-Open No. 2000-161254, for example, is known as a refrigerant compressor used in refrigeration air conditioning equipment. As is shown in the vertical cross sectional view in FIG. 5, this scroll compressor is formed by providing a compressing mechanism that compresses refrigerant gas and an electric motor section that drives the compressing mechanism inside a sealed container 10.

Here, a fixed scroll 1 and an orbiting scroll 2 form the center of the compressing mechanism. An outer peripheral portion of the fixed scroll 1 is fastened by a bolt or the like (not shown) to a guide frame 15 that is fastened to a sealed container 10. The fixed scroll 1 is provided with a base plate 1*a,* which is shaped as a circular plate, and plate shaped spiral teeth 1*b* that are formed on the surface on one side (the lower side surface in FIG. 5) of the base plate 1*a.* A pair of Oldham guide grooves 1*c* is formed substantially in a straight line at an outer peripheral portion of the fixed scroll 1. A pair of fixed claws 9*c* of an Oldham ring 9 engage with the Oldham guide grooves 1*c* so as to be able to slide freely in reciprocal directions.

The orbiting scroll 2 is also formed from a base plate shaped as a circular plate and plate shaped spiral teeth 2*b* that are formed on the surface on one side (the upper side surface in FIG. 5) of the base plate 2*a.* The configuration of the plate shaped spiral teeth 2*b* is formed in substantially the same spiral configuration as the plate shaped spiral teeth 1*b* of the fixed scroll 1. A boss 2*f,* which is shaped as a hollow cylinder, is formed at a center portion of the surface on the opposite side to the surface on which the plate shaped spiral teeth 2*b* are formed (i.e., on the lower side surface in FIG. 5) of the base plate 2*a.* A bearing 2*c* of the orbiting scroll 2 is formed in an inner peripheral surface of the boss 2*f.* A thrust surface 2*d,* which is capable of sliding so as to press contact a thrust bearing 3*a* of a compliant frame 3, is also formed in an outer peripheral portion of this surface (i.e., the lower side surface in FIG. 5

A pair of Oldham guide grooves 2*e,* which have a phase difference of substantially 90 degrees relative to the Oldham guide grooves 1*c* of the fixed scroll 1, are formed substantially in a straight line at an outer peripheral portion of the base plate 2*a* of the orbiting scroll 2. A pair of oscillating claws 9*a* of the Oldham ring 9 engage with the Oldham guide grooves 2*e* so as to be able to slide freely in reciprocal directions. An extraction hole 2*j,* which is a small hole that connects the surface of the base plate 2*a* facing the fixed scroll 1 (the upper side surface in FIG. 5) with the surface of the base plate 2*a* on the compliant frame 3 side (the lower side surface in FIG. 5), is formed in the base plate 2*a.*

The center locus of the aperture of the extraction hole 2*j* in the surface on the compliant frame 3 side, namely, the lower surface aperture 2*k* opens onto a position normally facing the thrust bearing 3*a* of the compliant frame 3 during A main support bearing 3*c,* which supports a crankshaft 4 in a radial direction, and an auxiliary main shaft 3*h* are formed at a central portion of the compliant frame 3. The crankshaft 4 is driven to rotate by the electric motor section. A connecting hole 3*s* that connects a frame space 15*f* to the thrust bearing 3*a* is formed in the compliant frame 3.

A connecting hole 3*n* that connects a base plate outer peripheral space 2*i* to a frame space 15*h* is also formed in the compliant frame 3. An adjusting valve housing space 3*p* is also formed in the compliant frame 3. One end of the adjusting valve housing space 3*p* is connected via an adjusting valve front flow path 3*j* to a boss exterior space 2*h,* while the other end of the adjusting valve housing space 3*p* is connected via the connecting hole 3*n* to the base plate outer peripheral space 2*i.*

In one end of the adjusting valve housing space 3*p* is housed an intermediate pressure adjusting valve 3*l* that is capable of free reciprocal operation. In the opposite end of the adjusting valve housing space 3*p* is housed an intermediate pressure adjusting spring cap 3*t* that is fixed to the compliant frame 3. Between the intermediate pressure adjusting valve 3*l* and the intermediate pressure adjusting spring cap 3*t* is positioned an intermediate pressure adjusting spring 3*m* that is compressed beyond its natural length. The intermediate pressure adjusting spring 3*m* urges the intermediate pressure adjusting valve 3*l* towards the adjusting valve front flow path 3*j.*

The outer peripheral surface of the guide frame 15 is fastened to an internal surface of the sealed container 10 by shrink fitting or welding or the like. However, a flow path is secured to guide high pressure refrigerant gas discharged from a discharge port 1*f* of the fixed scroll 1 to a discharge pipe 10*b* provided on the electric motor side of the guide frame 15 (i.e., on the lower side in FIG. 5).

An upper meshing circumferential inner surface 15*a* is formed on the fixed scroll 1 side (i.e., on the upper side in FIG. 5) of the inner surface of the guide frame 15. The upper meshing circumferential inner surface 15*a* abuts against an upper meshing circumferential outer surface 3*d* formed on the outer peripheral surface of the compliant frame 3.

A lower meshing circumferential inner surface 15*b* is formed on the electric motor side (i.e., on the lower side in FIG. 5) of the inner surface of the guide frame 15. The lower meshing circumferential inner surface 15*b* abuts against a lower meshing circumferential outer surface 3*e* formed on the outer peripheral surface of the compliant frame 3. Annular sealing grooves which house sealing members 16*a* and 16*b* are formed in two rows on the inner surface of the guide frame 15. The annular upper sealing member 16*a* and the lower sealing member 16*b* are each fitted into the respective sealing groove.

A space formed by the two sealing members 16*a* and 16*b,* the inner surface of the guide frame 15 and the outer surface of the compliant frame 3 forms the frame space 15*f.* A space on the outer peripheral side of the thrust bearing 3*a* enclosed at top and bottom by the base plate 2*a* of the orbiting scroll and the compliant frame 3, namely, a base plate outer peripheral space 2*i* is connected to an intake space 1*g,* which is adjacent to the end of the outer winding of the plate shaped spiral teeth 1*b,* and forms a low pressure space of an intake gas atmosphere (intake pressure).

An eccentric portion 4*b* of the crankshaft 4 that is supported so as to be freely rotatable by the bearing 2*c* of the orbiting scroll 2 is formed at the orbiting scroll 2 end of the crankshaft 4 (i.e., at the upper side in FIG. 5). Below that is formed a main portion 4*c* of the crankshaft 4 that is supported so as to be freely rotatable by the main bearing 3*c* and the auxiliary main bearing 3*c* and the auxiliary main bearing 3*h* of the compliant frame 3. At the other end of the crankshaft 4 is formed a sub portion 4*d* of the crankshaft 4 that is supported so as to be freely rotatable by a sub bearing 6*a* of a sub frame 6. Between this sub portion 4*d* of the crankshaft 4 and the aforementioned main portion 4*c* of the crankshaft 4 is shrink fitted a rotator 8 of the electric motor. An oil pipe 4*f* is press inserted in the bottom end surface of the crankshaft 4. Refrigerating machine oil 10*e* that is held in the bottom portion of the sealed container 10 is suctioned up into a high pressure oil supply hole 4*g*, which is formed inside the crankshaft 4, by the operation of the compressor mechanism.

The operation of the scroll compressor will be described. Firstly, during steady operation, an interior space 10*d* of the sealed container 10 contains a high pressure atmosphere generated by discharged refrigerant gas. The refrigerating machine is 10*e* in the bottom portion of the sealed container 10 climbs up inside the oil pipe 4*f* and the high pressure oil supply hole 4*g* and is guided to the boss space 2*g*. The refrigerating machine oil 10*e*, which is now at high pressure, is decompressed by the bearing 2*c* of the orbiting scroll 2 and as to be at an intermediate pressure that is greater than the intake pressure and less than the discharge pressure. It then flows into the boss exterior space 2*h*.

The high pressure refrigerating machine oil 10*e* that has climbed up the high pressure oil supply hole 4*g* is guided from a side hole (not shown) formed as an alternative path at a position partway along the high pressure oil supply hole 4*g* to the high pressure end surface (the lower end surface in FIG. 5) of the main bearing 3*c*. It is then decompressed by the main bearing 3*c* so as to be at intermediate pressure and flows in the same way as the above oil into the boss exterior space 2*h*.

The refrigerating machine oil 10*e* (generally, this is a two phase flow consisting of the refrigerant gas and the refrigerating machine oil 10*e* that is formed by the foaming of the refrigerant that has dissolved in the refrigerating machine oil 10*e*) that is at intermediate pressure inside the boss exterior space 2*h* passes along the adjusting valve front flow passage 3*j* and pushes up the intermediate pressure adjusting valve 3*l* as it resists the urging force from the intermediate pressure adjusting spring 3*m*. The refrigerating machine oil 10*e* then flows into an intake pressure atmosphere, namely, the adjusting valve housing space 3*p*, which is a low pressure atmosphere, and is then discharged into the base plate outer peripheral space 2*i* after passing through the connecting hole 3*n*.

As is described above, the intermediate pressure Pm1 in the boss exterior space 2*h* is controlled by a predetermined pressure $\alpha$ that is substantially decided in accordance with the spring force of the intermediate pressure adjusting spring 3*m* and the intermediate pressure exposure area of the intermediate pressure adjusting valve 3*l*. The intermediate pressure Pm1 can be expressed by $Pm1=Ps+\alpha$. Here, Ps represents intake atmosphere pressure (low pressure).

In contrast, the lower side aperture 2*k* of the extraction hole 2*j* formed in the base plate 2*a* of the orbiting scroll 2 is either always or intermittently connected with an upper side aperture 3*u* (i.e. an aperture on the upper surface side in FIG. 5), which is the aperture on the thrust bearing 3*a* side of the connecting hole 3*s* provided in the compliant frame 3. Therefore, the intermediate pressure refrigerant gas, which is currently being compressed and is at greater pressure than the intake pressure and at less pressure than the discharge pressure, is guided from a compression chamber formed by the fixed scroll 1 and the orbiting scroll 2 to the frame space 15*f* via the extraction hole 2*j* in the orbiting scroll and the connecting hole 3*s* in the compliant frame 3.

Because the frame space 15*f* is a closed space that is sealed by the upper sealing member 16*a* and the lower sealing member 16*b*, during normal operation, a weak flow is generated in both directions between the compression chamber and the frame space 15*f* in accordance with pressure variations in the compression chamber.

As is described above, the intermediate pressure Pm2 in the frame space 15*f* is controlled by a predetermined magnification $\beta$ that is substantially decided in accordance with the position in the connecting compression chamber. The intermediate pressure Pm2 can be expressed by $Pm2=Ps\times\beta$.

While a combined force of the force generated by the intermediate pressure Pm1 of the boss exterior space 2*h* and the urging force from the orbiting scroll 2 via the thrust bearing 3*a* acts as a force in the downward direction on the compliant frame 3, a combined force of the force generated by the intermediate pressure Pm2 of the frame space 15*f* and the force generated by the high pressure acting on the portion of the bottom end surface that is exposed to the high pressure atmosphere acts as a force in the upward direction on the compliant frame 3. During normal operation, this upward force is set greater than the downward force.

As a result, the upper meshing circumferential outer surface 3*d* of the compliant frame 3 is guided into the upper meshing circumferential inner surface 15*a* of the guide frame 15, and the lower meshing circumferential outer surface 3*e* of the compliant frame 3 is guided into the lower meshing circumferential inner surface 15*b* of the guide frame 15. The compliant frame 3 is thus able to slide in an axial direction along the guide frame 15 so as to rise up towards the fixed scroll 1 side (i.e., towards the upper side in FIG. 5). The orbiting scroll 2, which is being pushed by the compliant frame 3 via the thrust bearing 3*a*, also rises up in the same way. As a result, the tips of the teeth of the orbiting scroll 2 slide in a state of abutment against the bottoms of the teeth of the fixed scroll 1 while the bottoms of the teeth of the orbiting scroll 2 slide in a state of abutment against the tips of the teeth of the fixed scroll 1.

The gas load generated when the refrigerant gas is compressed and forces such as the centrifugal force of the balance weight and the centrifugal force of the orbiting scroll 2 act in a direction orthogonal to the crankshaft 4 on the main bearing 3*c* and the auxiliary main bearing 3*h* of the compliant frame 3. These forces are transmitted to the guide frame 15 via the upper meshing circumferential outer surface 3*d* and the lower meshing circumferential outer surface 3*e* of the compliant frame 3.

However, a uniform load parallel to the axial direction does not act constantly on the main bearing 3*c* and the auxiliary main bearing 3*h* of the compliant frame 3. Instead, a distributed load acts relative to the axial direction and because the distance between the upper meshing circumferential outer surface 3*d* and the lower meshing circumferential outer surface 3*e* of the compliant frame 3 is not equal to the distance between the points where the load acts on the main bearing 3*c* and the auxiliary main bearing 3*h*, moments are generated that slant the compliant frame 3 relative to the axial direction.

These moments are transmitted to the guide frame 15 through the upper meshing circumferential inner surface 15*a* and the lower meshing circumferential inner surface 15*b*, however, because the guide frame 15 is fastened to the sealed container 10 by shrink fitting or the like, it is possible to keep the compliant frame 3 stable without causing it to be slanted.

Thus, although the compliant frame 3 itself is able to move in the axial direction while maintaining moment balance, the force from the load on the bearing and the like acts on the guide frame 15 via the upper meshing circumferential outer surface 3*d* and the lower meshing circumferential outer surface 3*e* of the compliant frame 3. Moreover, because of the difference between the load acting on the upper meshing circumferential inner surface 15*a* of the guide frame 15 and the load acting on the lower meshing circumferential inner surface 15*b* of the guide frame 15, moments are generated that cause the guide frame 15 to rotate.

Therefore, when the guide frame 15 is fastened to the sealed container 10, the problem arises that, in some cases, an excessive force acts on the portions where the guide frame 15 is fastened to the sealed container 10 due to the moments acting on the guide frame 15.

Moreover, when the guide frame 15 is fastened to the sealed container 10, a distortion is generated in the guide frame 15. When the position where the guide frame 15 is fastened to the sealed container 10 is closer to one of the upper meshing circumferential inner surface 15*a* and the lower meshing circumferential inner surface 15*b* of the guide frame 15, the distortion in the fastening portion of the guide frame 15 that is generated by the fastening of the guide frame 15 to the sealed container 10 generates a distortion in the meshing circumferential inner surface of the closer one of the upper meshing circumferential inner surface 15*a* and the lower meshing circumferential inner surface 15*b* of the guide frame 15. The problems thus arise of the distortion preventing the compliant frame 15 from sliding smoothly in the axial direction and the compliant frame 3 becoming eccentric relative to the crankshaft 4.

Furthermore, the guide frame 15 is fastened to the sealed container 10 by welding, shrink fitting, or the like, however, conventionally, when a fastening position is decided, no consideration is given to the relationship between the position and notch position of the stator 7 of the electric motor. Namely, when the stator 7 is press inserted into or shrink fitted to the sealed container 10, there is a deformation in the portion of the sealed container 10 that corresponds to the notch of the stator 7. However, if the position where the guide frame 15 is fastened to the sealed container 10 is at the same phase as the notch position of the stator 7, the problem arises that the center of the guide frame 15 and the center of the stator 7 become displaced and it is not possible to make the air gap between the stator 7 and the rotator 8 of the electric motor uniform over the entire circumference.

Further, when the guide frame 15 is fastened to the sealed container 10, the outer peripheral surface of the guide frame 15 is on the same circumferential surface as the outer peripheral surface of the fixed scroll 1, however, in this case, portions other than the portion where the guide frame 15 is fastened by welding or the like to the sealed container 10 come into contact with the inner surface of the sealed container 10 due to vibration when the compressor is in operation creating the problem that abnormal noises such as chattering and the like are generated.

SUMMARY OF THE INVENTION

It is a first object thereof to provide a scroll compressor in which the moments acting on the guide frame are reduced, namely, in which no excessive force acts on a portion where the guide frame is fastened to the sealed container.

It is a second object of the present invention to provide a scroll compressor in which the distortion in the fastening portion generated when the guide frame is fastened to the sealed container does not affect the upper meshing circumferential inner surface and the lower meshing circumferential inner surface of the guide frame.

It is a third object of the present invention to provide a scroll compressor in which the deformation of the sealed container that occurs when the stator of the electric motor is either shrink fitted to or press inserted in the sealed container does not affect the guide frame fastening position.

It is a fourth object of the present invention to provide scroll compressor in which the fastening portion where the guide frame is fastened to the sealed container has a high degree of strength and a high degree of reliability.

It is a fifth object of the present invention to provide a scroll compressor in which the guide frame and the fixed scroll do not come into contact with sealed container while the compressor is in operation so that abnormal noises caused by such contact are not generated.

In order to achieve the above objects, according to a first aspect of the present invention, there is provided a scroll compressor comprising: a fixed scroll and an orbiting scroll that are provided inside a sealed chamber and are meshed together such that a compression chamber is formed between plate shaped spiral teeth of each scroll; a compliant frame that supports in a radial direction a main shaft that supports the orbiting scroll in an axial direction while rotating the orbiting scroll; and a guide frame that is fastened to the sealed container and that supports the compliant frame in the radial direction in two or more different locations in the axial direction, in which the orbiting scroll is able to be moved in the axial direction when the compliant frame slides in the axial direction relative to the guide frame, wherein the guide frame and the sealed container are fastened in an axial direction range corresponding to the two or more locations of the support positions between the guide frame and the compliant frame.

According to the first aspect, because the guide frame and the sealed container are fastened in an axial direction range corresponding to the two or more locations of the support positions between the guide frame and the compliant frame, even if moments from the complaint frame act via the two or more support positions on the guide frame, because the guide frame is supported by being fastened to the sealed container within a range in the axial direction that corresponds to the support positions, the moments relating to the fastening portions are smaller than the moments acting from the compliant frame and the load generated in the fastening portion is decreased.

According to a second aspect of the present invention, there is provided the scroll compressor in the first aspect, wherein the support positions between the compliant frame and the guide frame are in two locations, and the guide frame and the sealed container are fastened at a substantially intermediate position in the axial direction corresponding to the two locations of the support positions.

According to the second aspect, moments acting on the guide frame from the compliant frame act from the two or more support positions, however, because the guide frame is fastened to the sealed container at substantially an intermediate position in the axial direction between the two support positions, the fastening portion is substantially equidistant in the axial direction from both support positions and moments relating to the fastening position are reduced to the minimum. As a result, no excessive force acts on the fastening portion and a stable fastening is obtained. In addition, because the effect on the meshing circumferential surfaces caused by the distortion generated in the fastening portion of the guide frame when the guide frame is fastened to the sealed container is reduced to the minimum, there is no hindrance of the sliding motion of the compliant frame in the axial direction and no eccentricity of the compliant frame relative to the crankshaft, thus improving reliability.

According to a third aspect of the present invention, there is provided the scroll compressor in the above aspects, wherein a phase position in a peripheral direction of the sealed container of a fastening position where the guide frame is fastened to the sealed container and a phase position in a peripheral direction of the sealed container of a fixed support position of a stator of an electric motor on the sealed container are matched.

According to the third aspect, by matching a fastening position where the guide frame is fastened to the sealed container and a fixed support position of a stator of an electric motor on the sealed container to a phase position in the peripheral direction of the sealed container, the distortion that is generated in the fixed support position of the sealed container by fixing the stator to the sealed container and the distortion that is generated in the fastening position of the sealed container when the guide frame is fastened to the sealed container are substantially matched in the peripheral direction of the sealed container. Therefore, the effects of one distortion on the other distortion are reduced to a minimum and the shift between the center of the guide frame and the center of the stator is reduced. Moreover, the air gap between the stator and the rotator of the electric motor is made substantially uniform over the entire periphery.

According to a fourth aspect of the present invention, there is provided the scroll compressor in the above aspects, wherein a rib is formed extending along an outer periphery of the guide frame and in close contact with an inner surface of the sealed container, and portions in three or more locations in the peripheral direction of the rib are fastened to the sealed container.

According to the fourth aspect, by fastening the sealed container to a rib that is formed extending in the peripheral direction at an outer peripheral portion of the guide frame, the fastening strength is improved. It is desirable that the respective angular intervals between each adjacent location of the three or more fastening locations where the sealed container is fastened to the rib is less than 180 degrees.

According to a fifth aspect of the present invention, there is provided the scroll compressor in the above aspect, wherein the rib and the sealed container are fastened together by shrink fitting or by arc spot welding. According to the fifth aspect, by fastening the rib of the guide frame to the sealed container by shrink fitting or by arc spot welding, the same fastening workability as in a conventional example is guaranteed, while the aforementioned improvement in the fastening strength is achieved.

According to a sixth aspect of the present invention, there is provided the scroll compressor in the above aspects, wherein substantially circular concave portions are provided in three or more locations in the rib and convex portions formed in the sealed container are fitted together with the substantially circular concave portions. According to the sixth aspect, by forming circular concave portions in the rib of the guide frame and fitting convex portions formed in the sealed container together with the substantially circular concave portions, the two are fastened firmly together and an improvement in reliability is achieved.

According to a seventh aspect of the present invention, there is provided the scroll compressor in the above aspects, wherein gaps are provided respectively between the outer peripheral surface of the guide frame and the outer peripheral surface of the fixed scroll and the inner peripheral surface of the sealed container in portions other than the fastening portions of the guide frame to the sealed container. According to the seventh aspect, because respective gaps are provided between portions other than the fastening portion where the guide frame is fastened to the sealed container by welding or the like and between the fixed scroll and the sealed container, the portions other than the fastening portion of the guide frame as well as the fixed scroll are prevented from coming into contact with the inner surface of the sealed container due to vibration when the compressor is in operation. Consequently abnormal noises caused by such contact such as chattering noises and the like are prevented and a quietly operating scroll compressor is achieved.

Other objects and features of this invention will become understood from the following description with reference to the accompanying drawings.

DETAILED DESCRIPTION

The embodiments of the scroll compressor according to the present invention will now be described with reference to the drawings.

First Embodiment

Figure 1:
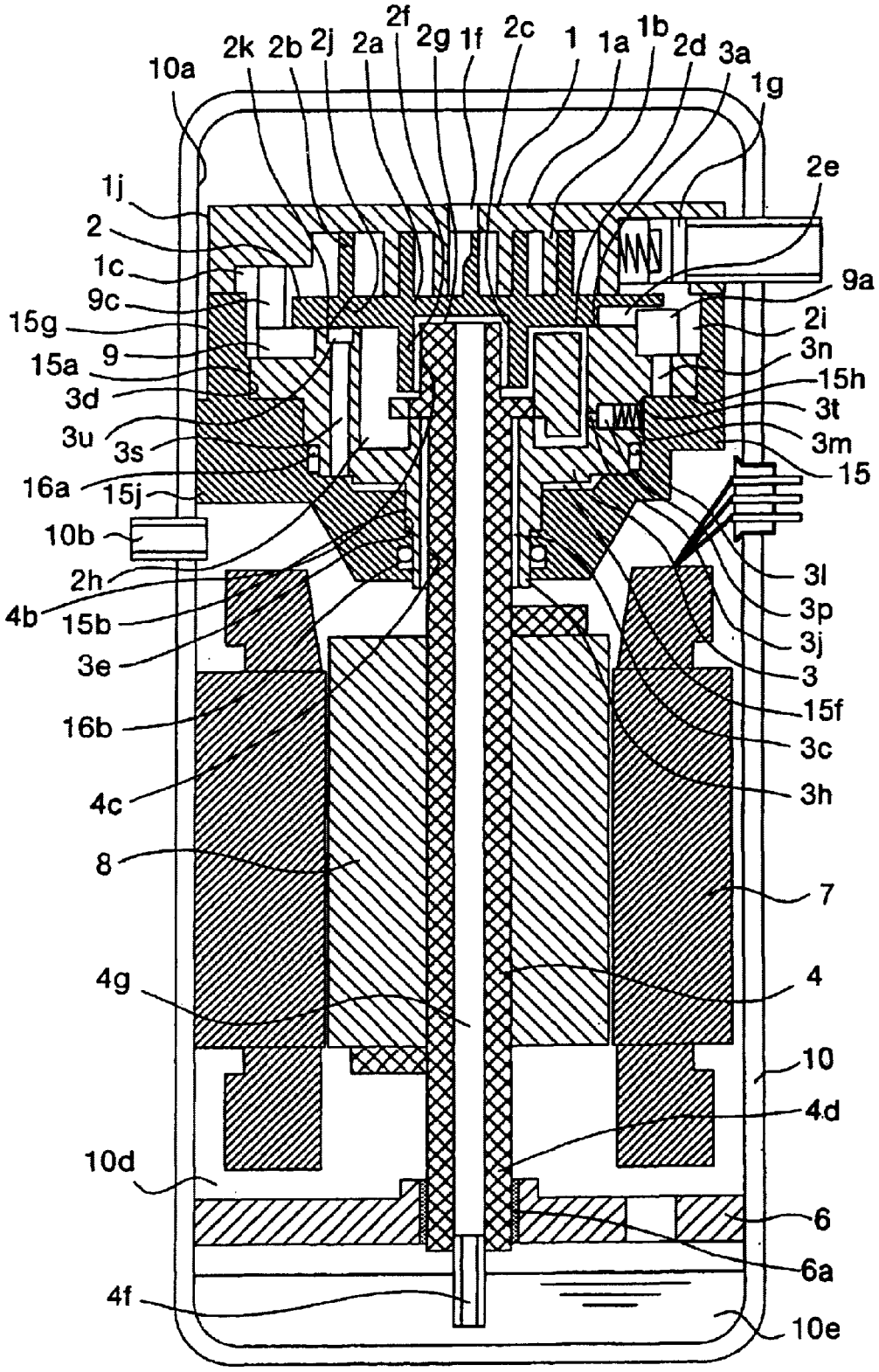
FIG. 1 is a vertical cross sectional view which shows the scroll compressor that is a first embodiment of the present invention.

FIG. 1 is a vertical cross sectional view which shows the scroll compressor that is a first embodiment of the present invention. This scroll compressor is formed by a compressor mechanism that compresses refrigerant gas and an electric motor that drives the compressor mechanism that are placed inside a sealed container 10.

The center of the compressor mechanism is formed by a fixed scroll 1 and an orbiting scroll 2. The outer periphery of the fixed scroll 1 is fastened to a guide frame 15 that is fastened to a sealed container 10 by bolts or the like (not shown). The fixed scroll 1 is provided with a base plate 1*a*, which is shaped as a circular plate, and plate shaped spiral teeth 1*b* that are formed on the surface on one side (the lower side surface in FIG. 1) of the base plate 1*a*. A pair of Oldham guide grooves 1*c* is formed substantially in a straight line at an outer peripheral portion of the fixed scroll 1. A pair of fixed claws 9*c* of an Oldham ring 9 engage with the Oldham guide grooves 1*c* so as to be able to slide freely in reciprocal directions.

The orbiting scroll 2 is also formed from a base plate shaped as a circular plate and plate shaped spiral teeth 2*b* that are formed on the surface on one side (the upper side surface in FIG. 1) of the base plate 2*a*. The configuration of the plate shaped spiral teeth 2*b* is formed in substantially the same spiral configuration as the plate shaped spiral teeth l*b* of the fixed scroll 1. A boss 2*f*, which is shaped as a hollow cylinder, is formed at a center portion of the surface on the opposite side to the surface on which the plate shaped spiral teeth 2*b* are formed (i.e., on the lower side surface in FIG. 1) of the base plate 2*a*. A bearing 2*c* of the orbiting scroll 2 is formed in an inner peripheral surface of the boss 2*f*. A thrust surface 2*d*, which is capable of sliding so as to press contact a thrust bearing 3*a* of a compliant frame 3, is also formed in an outer peripheral portion of this surface (i.e., the lower side surface in FIG. 1).

A pair of Oldham guide grooves 2*e*, which have a phase difference of substantially 90 degrees relative to the Oldham guide grooves 1*c* of the fixed scroll 1, are formed substantially in a straight line at an outer peripheral portion of the base plate 2*a* of the orbiting scroll 2. A pair of oscillating claws 9*a* of the Oldham ring 9 engage with the Oldham guide grooves 2*e* so as to be able to slide freely in reciprocal directions. An extraction hole 2*j*, which is a small hole that connects the surface of the base plate 2*a* facing the fixed scroll 1 (the upper side surface in FIG. 1) with the surface of the base plate 2*a* on the compliant frame 3 side (the lower side surface in FIG. 1), is formed in the base plate 2*a*.

The center locus of the aperture of the extraction hole 2*j* in the surface on the compliant frame 3 side, namely, the lower surface aperture 2*k* opens onto a position normally facing the thrust bearing 3*a* of the compliant frame 3 during normal operation.

A main support bearing 3*c*, which supports a crankshaft 4 in a radial direction, and an auxiliary main shaft 3*h* are formed at a central portion of compliant frame 3. The crankshaft 4 is driven to rotate by the electric motor. A first connecting hole 3*s* that connects frame space 15*f* to the thrust bearing 3*a* is formed in the compliant frame 3.

A second connecting hole 3*n* that connects a base plate outer peripheral space 2*i* to a frame space 15*h* is also formed in the compliant frame 3. An adjusting valve housing space 3*p* is also formed in the compliant frame 3. One end of the adjusting valve housing space 3*p*is connected via an adjusting valve front flow path 3*j* to a boss exterior space 2*h*, while the other end of the adjusting valve housing space 3*p* is connected via the second connecting hole 3*n* to the base plate outer peripheral space 2*i*.

In one end of the adjusting valve housing space 3*p* is housed an intermediate pressure adjusting valve 3*l* that is capable of free reciprocal operation. In the opposite end of the adjusting valve housing space 3*p* is housed an intermediate pressure adjusting spring cap 3*t* that is fixed to the compliant frame 3. Between the intermediate pressure adjusting valve 3*l* and the intermediate pressure adjusting spring cap 3*t* is positioned an intermediate pressure adjusting spring 3*m* that is compressed beyond its natural length. The intermediate pressure adjusting spring 3*m* urges the intermediate pressure adjusting valve 3*l* towards the adjusting valve front flow path 3*j*.

An upper meshing circumferential inner surface 15*a* is formed on the fixed scroll 1 side (i.e., on the upper side in FIG. 1) of the inner surface of the guide frame 15. The upper meshing circumferential inner surface 15*a* abuts against an upper meshing circumferential outer surface 3*d* formed on the outerperipheral surface of the compliant frame 3. A lower meshing circumferential inner surface 15*b* is formed on the electric motor side (i.e., on the lower side in FIG. 1) of the inner surface of the guide frame 15. The lower meshing circumferential inner surface 15*b* abuts against a lower meshing circumferential outer surface 3*e* formed on the outer peripheral surface of the compliant frame 3. It is also possible for other circumferential surfaces to be meshed together between the upper meshing circumferential inner surface 15*a* and the upper meshing circumferential outer surface 3*d* and between the lower meshing circumferential inner surface 15*b* and the lower meshing circumferential outer surface 3*e* in the guide frame 15 and the compliant frame 3.

Figure 2:
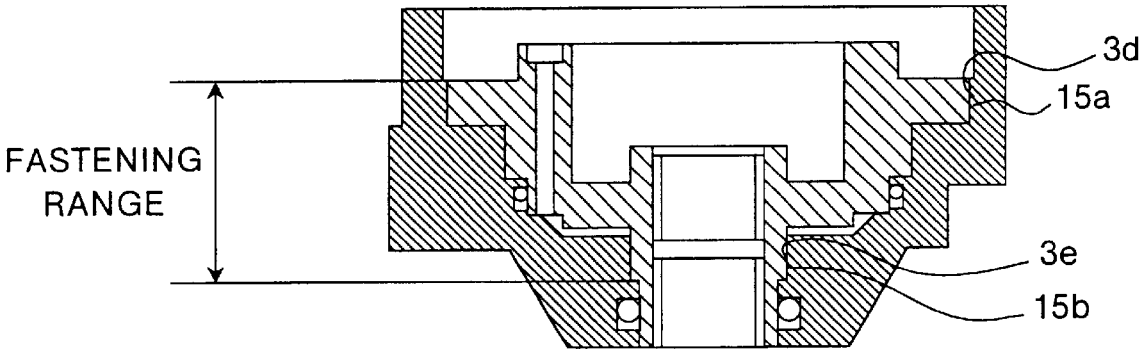
FIG. 2 is a view which shows a fastening position in an axial direction of a guide frame and a sealed container.

A rib 15*j* is formed in the outer periphery of the guide frame 15. The rib 15*j* extends in a circumferential direction and is fastened to the sealed container 10. The guide frame 15 is inserted into a predetermined position in the sealed container 10 and a portion of the rib 15*j* is fastened to the sealed container 10 by arc spot welding or the like. As is shown in FIG. 2, the position in the axial direction where the guide frame 15 is fastened to the sealed container 10 is between the upper meshing circumferential inner surface 15*a* and the lower meshing circumferential inner surface 15*b* of the guide frame 15.

The outer peripheral surface 15*g*, which is the portion of the guide frame 15 extending from the rib 15*j* in the axial direction toward a portion where the fixed scroll 1 is fastened, and the outer peripheral surface 1*j* of the fixed scroll 1 are separated from the inner peripheral surface 10*a* of the sealed container 10 by a gap large enough that for the sealed container 10 to not be allowed to contact the guide frame 15 by deformation or the like of the sealed container 10. A flow path is secured to guide high pressure refrigerant gas discharged from a discharge port if of the fixed scroll 1 to a discharge pipe 10*b* provided on the electric motor side of the guide frame 15 (i.e., on the lower side in FIG. 1).

Annular sealing grooves which house sealing members 16*a* and 16*b* are formed in two rows on the inner surface of the guide frame 15. The annular upper sealing member 16*a* and the lower sealing member 16*b* are each fitted into the respective sealing groove.

A space formed by the two sealing members 16*a* and 16*b*, the inner surface of the guide frame 15 and the outer surface of the compliant frame 3 forms the frame space 15*f*. A space on the outer peripheral side of the thrust bearing 3*a* enclosed at top and bottom by the base plate 2*a* of the orbiting scroll and the compliant frame 3, namely, a base plate outer peripheral space 2*i* is connected to an intake space 1*g*, which is adjacent to the end of the outer winding of the plate shaped spiral teeth 1*b*, and forms a low pressure space of an intake gas atmosphere (intake pressure).

Figure 3:
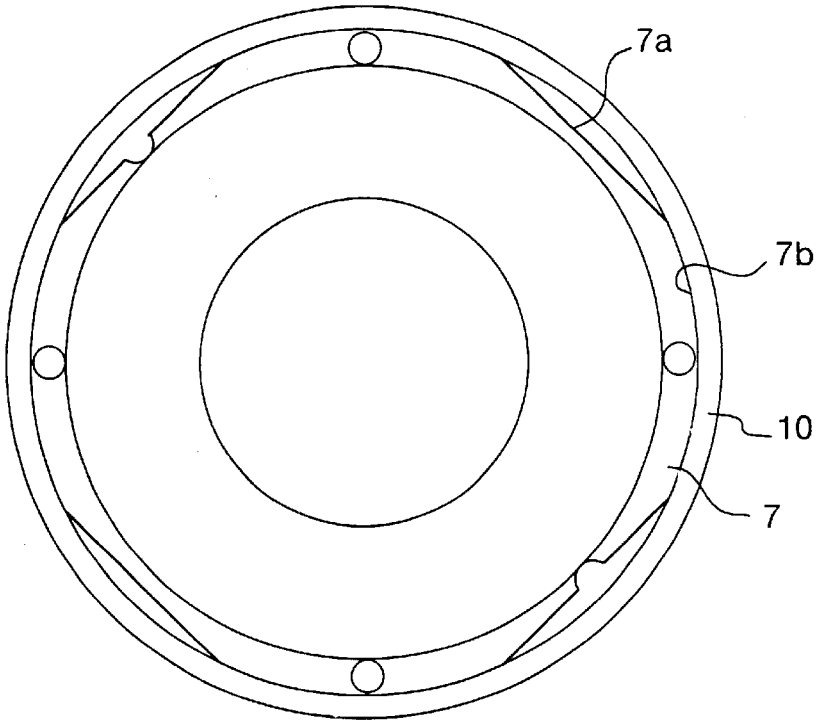
FIG. 3 is a plan view which shows a state in which a stator of an electric motor is shrink fitted in or press inserted into a sealed container.

FIG. 3 is a plan view which shows a state in which a stator 7 of an electric motor is shrink fitted in or press inserted into the sealed container 10. Notches 7*a* are provided at two or more locations in the stator 7. The portions 7*b* other than the notches 7*a* are in contact with the inner peripheral surface of the sealed container 10 so that the stator 7 is fixed to the sealed container 10. The position where the guide frame 15 is fastened to the sealed container 10 is on a vertical axial line of the contact portion between the stator 7 and the sealed container 10, namely, is at the same phase position relative to the circumferential surface of the sealed container 10.

Figure 5:
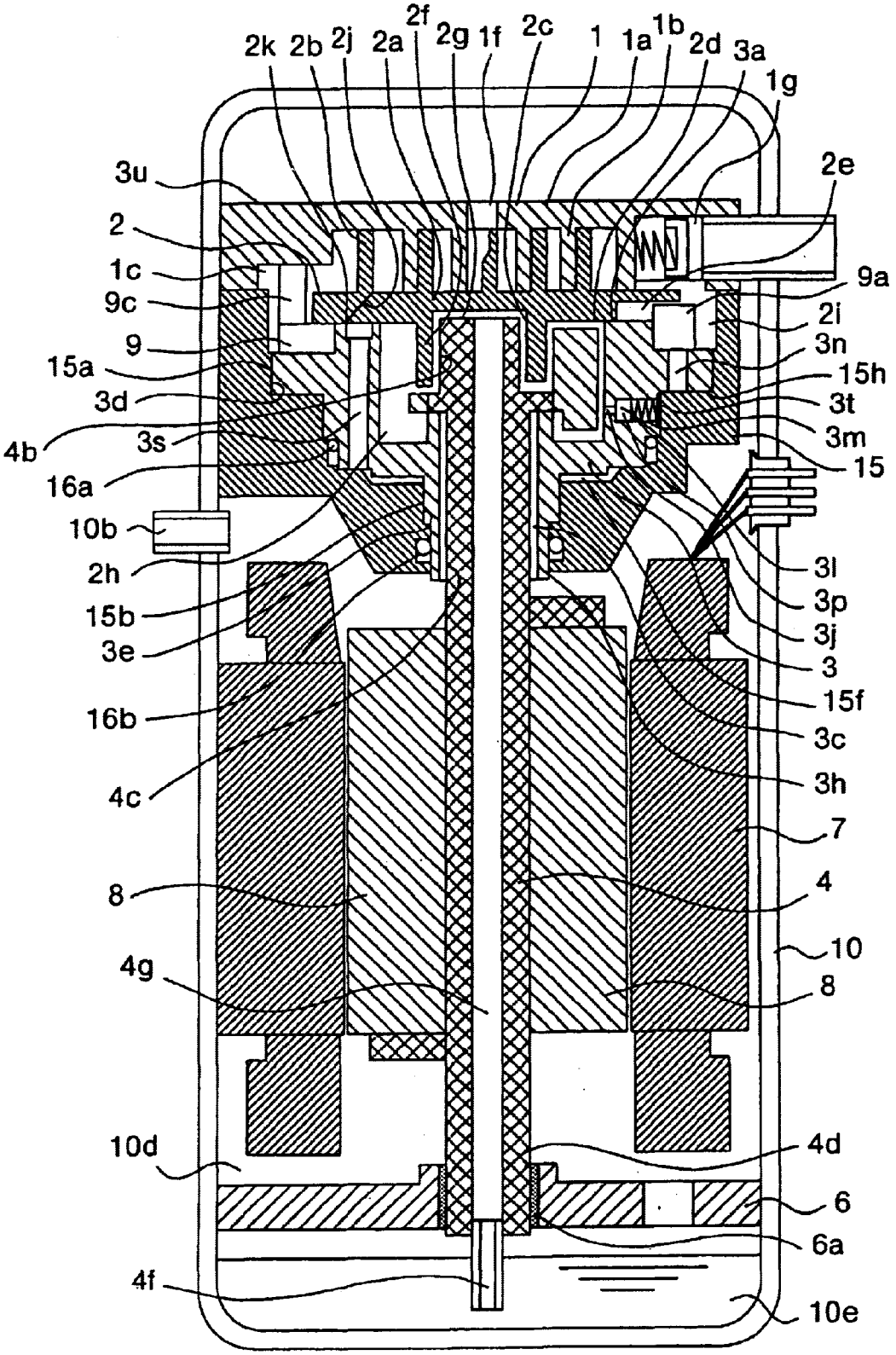
FIG.5 PRIOR ART
FIG. 5 is a vertical cross sectional view which shows a conventional scroll compressor.

An eccentric portion 4*b* of the crankshaft 4 that is supported so as to be freely rotatable by the bearing 2*c* of the orbiting scroll 2 is formed at the orbiting scroll 2 end of the crankshaft 4 (i.e., at the upper side in FIG. 5). Below that is formed a main portion 4*c* of the crankshaft 4 that is supported so as to be freely rotatable by the main bearing 3*c* and the auxiliary main bearing 3*h* of the compliant frame 3. At the other end of the crankshaft 4 is formed a sub portion 4*d* of the crankshaft 4 that is supported so as to be freely rotatable by a sub bearing 6*a* of a sub frame 6. Between this sub portion 4*d* of the crankshaft 4 and the aforementioned main portion 4*c* of the crankshaft 4 is shrink fitted a rotator 8 of the electric motor. An oil pipe 4*f* is press inserted in the bottom end surface of the crankshaft 4. Refrigerating machine oil 10*e* that is held in the bottom portion of the sealed container 10 is suctioned up into a high pressure oil supply hole 4*g*, which is formed inside the crankshaft 4, by the operation of the compressor mechanism.

The operation of the scroll compressor will now be described. Firstly, during steady operation, an interior space 10*d* of the sealed container 10 contains a high pressure atmosphere generated by discharged refrigerant gas. The refrigerating machine oil 10*e* in the bottom portion of the sealed container 10 climbs up inside the oil pipe 4*f* and the high pressure oil supply hole 4*g* and is guided to the boss space 2*g*. The refrigerating machine oil 10*e*, which is now at high pressure, is decompressed by the oscillating bearing 2*c* and so as to be at an intermediate pressure that is greater than the intake pressure and less than the discharge pressure. It then flows into the boss exterior space 2*h*.

The high pressure refrigerating machine oil 10*e* that has climbed up the high pressure oil supply hole 4*g* is guided from a side hole (not shown) formed as an alternative path at a position partway along the high pressure oil supply hole 4*g* to the high pressure end surface (the lower end surface in FIG. 1) of the main bearing 3*c*. It is then decompressed by the main bearing 3*c* so as to be at intermediate pressure and flows in the same way as the above oil into the boss exterior space 2*h*.

The refrigerating machine oil 10*e* (generally, this is a two phase flow consisting of the refrigerant gas and the refrigerating machine oil 10*e* that is formed by the foaming of the refrigerant that has dissolved in the refrigerating machine oil 10*e*) that is at intermediate pressure inside the boss exterior space 2*h* passes along the adjusting valve front flow passage 3*j* and pushes up the intermediate pressure adjusting valve 3*l* as it resists the urging force from the intermediate pressure adjusting spring 3*m*. The refrigerating machine oil 10*e* then flows into an intake pressure atmosphere, namely, the adjusting valve housing space 3*p*, which is a low pressure atmosphere, and is then discharged into the base plate outer peripheral space 2*i* after passing through the connecting hole 3*n*.

As is described above, the intermediate pressure Pm1 in the boss exterior space 2*h* is controlled by a predetermined pressure $\alpha$ that is substantially decided in accordance with the spring force of the intermediate pressure adjusting spring 3*m* and the intermediate pressure exposure area of the intermediate pressure adjusting valve 3*l*. The intermediate pressure Pm1 can be expressed by $Pm1=Ps+\alpha$. Here, Ps represents intake atmosphere pressure (low pressure).

In contrast, the lower side aperture 2*k* of the extraction hole 2*j* formed in the base plate 2*a* of the orbiting scroll 2 is either always or intermittently connected with an upper side aperture 3*u* (i.e. an aperture on the upper surface side in FIG. 5), which is the aperture on the thrust bearing 3*a* side of the connecting hole 3*s* provided in the compliant frame 3. Therefore, the intermediate pressure refrigerant gas, which is currently being compressed and is at greater pressure than the intake pressure and at less pressure than the discharge pressure, is guided from a compression chamber formed by the fixed scroll 1 and the orbiting scroll 2 to the frame space 15*f* via the extraction hole 2*j* in the orbiting scroll 2 and the connecting hole 3*s* in the compliant frame 3.

Because the frame space 15*f* is a closed space that is sealed by the upper sealing member 16*a* and the lower sealing member 16*b*, during normal operation, a weak flow is generated in both directions between the compression chamber and the frame space 15*f* in accordance with pressure variations in the compression chamber.

In this way, the intermediate pressure Pm2 in the frame space 15*f* is controlled by a predetermined magnification $\beta$ that is substantially decided in accordance with the position in the connecting compression chamber. The intermediate pressure Pm2 can be expressed by $Pm2=Ps\times\beta$.

While a combined force of the force generated by the intermediate pressure Pm1 of the boss exterior space 2*h* and the urging force from the orbiting scroll 2 via the thrust bearing 3*a* acts as a force in the downward direction on the compliant frame 3, a combined force of the force generated by the intermediate pressure Pm2 of the frame space 15*f* and the force generated by the high pressure acting on the portion of the bottom end surface that is exposed to the high pressure atmosphere acts as a force in the upward direction on the compliant frame 3. During normal operation, this upward force is set greater than the downward force.

As a result, the upper meshing circumferential outer surface 3*d* of the compliant frame 3 is guided into the upper meshing circumferential inner surface 15*a* of the guide frame 15, and the lower meshing circumferential outer surface 3*e* of the compliant frame 3 is guided into the lower meshing circumferential inner surface 15*b* of the guide frame 15. The compliant frame 3 is thus able to slide in an axial direction along the guide frame 15 so as to rise up towards the fixed scroll 1 side (i.e., towards the upper side in FIG. 5). The orbiting scroll 2, which is being pushed by the compliant frame 3 via the thrust bearing 3*a*, also rises up in the same way. As a result, the tips of the teeth of the orbiting scroll 2 slide in a state of abutment against the bottoms of the teeth of the fixed scroll 1 while the bottoms of the teeth of the orbiting scroll 2 slide in a state of abutment against the tips of the teeth of the fixed scroll 1.

The gas load generated when the refrigerant gas is compressed and forces such as the centrifugal force of the balance weight and the centrifugal force of the orbiting scroll 2 act in a direction orthogonal to the crankshaft 4 on the main bearing 3*c* and the auxiliary main bearing 3*h* of the compliant frame 3. These forces are transmitted to the guide frame 15 via the upper meshing circumferential outer surface 3*d* and the lower meshing circumferential outer surface 3*e* of the compliant frame 3 and are further transmitted from the guide frame 15 to the fastening portion where the guide frame 15 is fastened to the sealed container 10.

Here, a uniform load parallel to the axial direction does not act constantly on the main bearing 3*c* and the auxiliary main bearing 3*h* of the compliant frame 3. The load acting on the upper meshing circumferential inner surface 15*a* of the guide frame 15 and the load acting on the lower meshing circumferential inner surface 15*b* of the guide frame 15 are unequal. If the point of action of the combined force of the loads acting on the upper meshing circumferential inner surface 15*a* and the lower meshing circumferential inner surface 15*b* of the guide frame 15 is at the same position in the axial direction as the fastening portion where the guide frame 15 is fastened to the sealed container 10, then no moment acts on the fastening portion of the guide frame 15 and the sealed container 10.

However, normally, because the point of action of this combined force changes in accordance with the load state of the compressor and the like, it is not possible at the design stage to decide the position at the supporting surface of the guide frame 15 and the compliant frame 3 (the upper meshing circumferential inner surface 15*a* and the upper meshing circumferential outer surface 3*d* together with the lower meshing circumferential inner surface 15*b* and the upper meshing circumferential outer surface 3*e*) such that no moment acts on the fastening portion of the guide frame 15 and the sealed container 10.

Moreover, a distortion is generated in the fastening portion of the guide frame 15 to the sealed container 10. When the fastening portion of the guide frame 15 to the sealed container 10 is close to the upper meshing circumferential inner surface 15*a* and the lower meshing circumferential inner surface 15*b* of the guide frame 15, this distortion affects the upper meshing circumferential inner surface 15*a* and the lower meshing circumferential inner surface 15*b* of the guide frame 15. Consequently, the compliant frame 3 is prevented from sliding smoothly and, in some cases, the compliant frame 3 becomes eccentric relative to the crankshaft 4.

However, by forming the fastening position where the guide frame 15 is fastened to the sealed container 10 at a substantially intermediate position between the upper meshing circumferential inner surface 15*a* of the guide frame 15 with the upper meshing circumferential outer surface 3*d* of the complaint frame 3 and the lower meshing circumferential inner surface 15*b* of the guide frame 15 with the lower meshing circumferential outer surface 3*e* of the complaint frame 3, as is the case in the scroll compressor of the present embodiment, the moments that act on the fastening position are mutually reduced in correspondence with a variety of load conditions. In addition, the effects of the distortion on the fastening position of the guide frame 15 to the sealed container 10 are reduced.

Moreover, because a gap large enough for the inner peripheral surface of the sealed container 10 to not be placed in contact with the outer peripheral surface 15*g* of the guide frame 15 and the outer peripheral surface 1*j* of the fixed scroll 1 by of the deformation of the sealed container 10 is formed between the outer peripheral surface 15*g* of the guide frame 15 and the inner peripheral surface 10*a* of the sealed container 10 in those parts other than the fastening portion of the guide frame 15 to the sealed container 10, the generation of abnormal noises caused by such contact is prevented.

Second Embodiment

Figure 4:
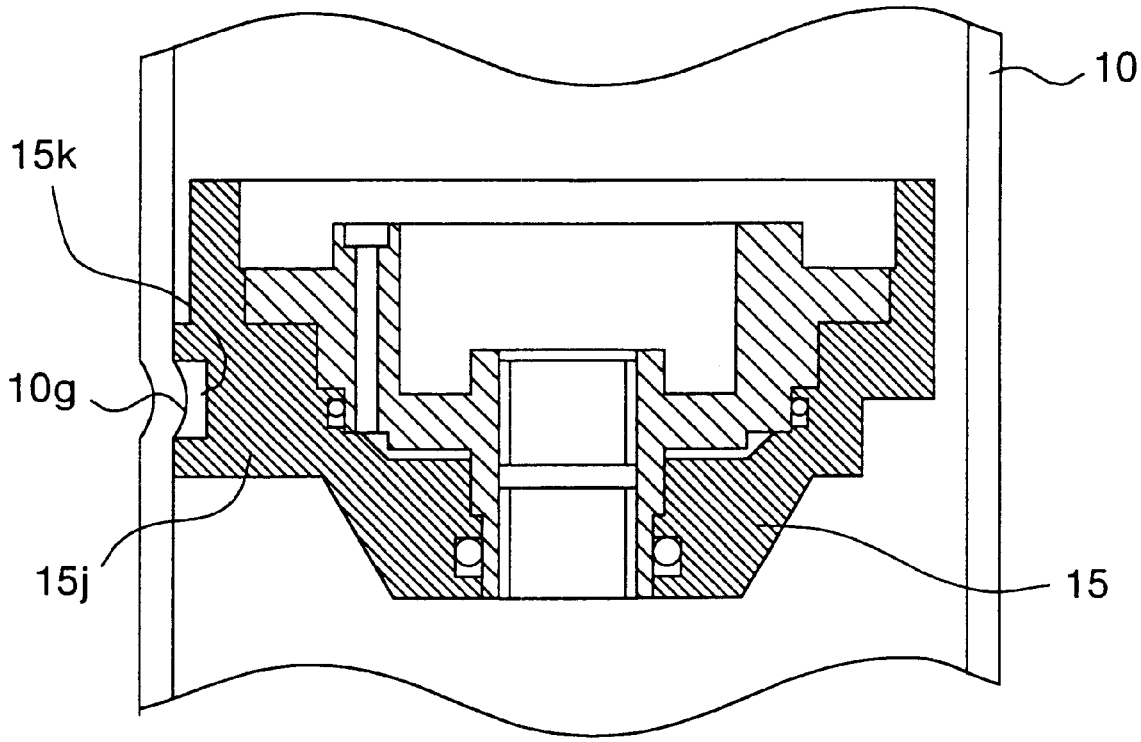
FIG. 4 is a cross sectional view which shows the main portions of the scroll compressor that is a second embodiment of the present invention.

FIG. 4 is a cross sectional view which shows the main portions of the scroll compressor that is a second embodiment of the present invention. In the scroll compressor of the first embodiment, the rib 15*j* provided in the guide frame 15 is fastened to the sealed container 10 by arc spot welding, shrink fitting, or the like, however, this fastening method is changed in the scroll compressor according to the second embodiment. The new fastening method will now be described.

A rib 15*j* is formed extending in the peripheral direction in the outer circumference of the guide frame 15 in order for the guide frame 15 to be fastened to the sealed container 10. Circular concave portions 15*k* are provided in at least three locations in the rib 15*j*. The guide frame 15 is fastened to the sealed container 10 by inserting the guide frame 15 at a predetermined position inside the sealed container 10. Thereafter, convex portions 10*g* are formed in the inner wall surface of the sealed container 10 by forming depressions in the portions of the sealed container 10 that correspond to the circular concave portions 15*k* in the guide frame 15. The convex portions 10*g* are fitted together with the circular concave portions 15*k* of the guide frame 15 resulting in the sealed container 10 and the guide frame 15 being securely fastened together.

As has been described above, according to the first aspect of the present invention, because the guide frame and the sealed container are fastened in an axial direction range corresponding to the two or more locations of the support positions between the guide frame and the compliant frame, even if moments from the complaint frame act via the two or more support positions on the guide frame, because the guide frame is supported by being fastened to the sealed container within a range in the axial direction that corresponds to the support positions, the moments relating to the fastening portions are smaller than the moments acting from the compliant frame and the load generated in the fastening portion is decreased.

According to the second aspect of the present invention, moments acting on the guide frame from the compliant frame act from the two or more support positions, however, because the guide frame is fastened to the sealed container at substantially an intermediate position in the axial direction between the two support positions, the fastening portion is substantially equidistant in the axial direction from both support positions and moments relating to the fastening position are reduced to the minimum. As a result, no excessive force acts on the fastening portion and a stable fastening is obtained. In addition, because the effect on the meshing circumferential surfaces caused by the distortion generated in the fastening portion of the guide frame when the guide frame is fastened to the sealed container is reduced to the minimum, there is no hindrance of the sliding motion of the compliant frame in the axial direction and no eccentricity of the compliant frame relative to the crankshaft, thus improving reliability.

According to the third aspect of the present invention, by matching a fastening position where the guide frame is fastened to the sealed container and a fixed support position of a stator of an electric motor on the sealed container to a phase position in the peripheral direction of the sealed container, the distortion that is generated in the fixed support position of the sealed container by fixing the stator to the sealed container and the distortion that is generated in the fastening position of the sealed container when the guide frame is fastened to the sealed container are substantially matched in the peripheral direction of the sealed container. Therefore, the effects of one distortion on the other distortion are reduced to a minimum and the shift between the center of the guide frame and the center of the stator is reduced. Moreover, the air gap between the stator and the rotator of the electric motor is made substantially uniform over the entire periphery.

According to the fourth aspect of the present invention, by fastening the sealed container to a rib that is formed extending in the peripheral direction at an outer peripheral portion of the guide frame, the fastening strength is improved.

According to the fifth aspect of the present invention, by fastening the rib of the guide frame to the sealed container by shrink fitting or by arc spot welding, the same fastening workability as in a conventional example is guaranteed, while the aforementioned improvement in the fastening strength is achieved.

According to the sixth aspect of the present invention, by forming circular concave portions in the rib of the guide frame and fitting convex portions formed in the sealed container together with the substantially circular concave portions, the two are fastened firmly together and an improvement in reliability is achieved.

According to the seventh aspect of the present invention, because respective gaps are provided between portions other than the fastening portion where the guide frame is fastened to the sealed container by welding or the like and between the fixed scroll and the sealed container, the portions other than the fastening portion of the guide frame as well as the fixed scroll are prevented from coming into contact with the inner surface of the sealed container due to vibration when the compressor is in operation. Consequently abnormal noises caused by such contact such as chattering noises and the like are prevented and a quietly operating scroll compressor is achieved.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A scroll compressor comprising:

a fixed scroll and an orbiting scroll that are provided inside a sealed container and are meshed together such that a compression chamber is formed between plate shaped spiral teeth of each scroll;

a compliant frame that supports a crankshaft in a radial direction, wherein the crankshaft supports the orbiting scroll in an axial direction while rotating the orbiting scroll; and a guide frame that is fastened to the sealed container and that supports the compliant frame in the radial direction in two or more different locations in the axial direction, in which the orbiting scroll is moved in the axial direction when the compliant frame slides in the axial direction relative to the guide frame, wherein the guide frame and the sealed container are fastened in an axial direction range corresponding to the two or more locations of the support positions between the guide frame and the compliant frame, and a fastening position where the guide frame is fastened to the sealed container and a fixed support position of a stator of an electric motor on the sealed container are matched to a phase position in a peripheral direction of the sealed container.

2. The scroll compressor according to claim 1, wherein the support positions between the compliant frame and the guide frame are in two locations, and the guide frame and the sealed container are fastened at a substantially intermediate position in the axial direction in relation to the two locations of the support positions.

3. The scroll compressor according to claim 1, wherein a rib is formed extending along an outer periphery of the guide frame and in close contact with an inner peripheral surface of the sealed container, and portions in three or more locations in the peripheral direction of the rib are fastened to the sealed container.

4. The scroll compressor according to claim 3, wherein substantially circular concave portions are provided in three or more locations in the rib and convex portions formed in the sealed container are fitted together with the substantially circular concave portions.

5. The scroll compressor according to claim 3, wherein gaps are provided respectively between the inner peripheral surface of the sealed container and the outer periphery of the guide frame and at a portion other than the fastening portions of the guide frame to the sealed container, and between an outer peripheral surface of the fixed scroll and the inner peripheral surface of the sealed container.

6. The scroll compressor according to claim 3, wherein the rib and the sealed container are fastened together by shrink fitting or by arc spot welding.

7. The scroll compressor according to claim 6, wherein substantially circular concave portions are provided in three or more locations in the rib and convex portions formed in the sealed container are fitted together with the substantially circular concave portions.

8. The scroll compressor according to claim 6, wherein gaps are provided respectively between the inner peripheral surface of the sealed container and the outer peripheral of the guide frame and at a portion other than the fastening portions of the guide frame to the sealed container, and between an outer peripheral surface of the fixed scroll and the inner peripheral surface of the sealed container.

* * * * *

UNITED STATES PATENT AND TRADEMARK OFFICE

CERTIFICATE OF CORRECTION

PATENT NO. : 6,648,618 B2
DATED : November 18, 2003
INVENTOR(S) : Teruhiko Nishiki et al.

It is certified that error appears in the above-identified patent and that said Letters Patent is hereby corrected as shown below:

Column 1,
Line 65, after "during" insert -- normal operation. --.
Line 67, change "shaft" to -- bearing --.

Column 3,
Line 17, change "is 10e" to -- oil 10e --.

Column 9,
Line 29, change "shaft" to -- bearing --.

Column 15,
Line 17, change "a compliant frame that supports a crankshaft in a radial direction, wherein the crankshaft supports the orbiting scroll in an axial direction while rotating the orbiting scroll; and" to -- a compliant frame that supports a crankshaft in a radial direction and the orbiting scroll in an axial direction while rotating the orbiting scroll; and --.

Signed and Sealed this

Twenty-first Day of June, 2005

JON W. DUDAS
*Director of the United States Patent and Trademark Office*

UNITED STATES PATENT AND TRADEMARK OFFICE

CERTIFICATE OF CORRECTION

PATENT NO. : 6,648,618 B2
APPLICATION NO. : 10/055903
DATED : November 18, 2003
INVENTOR(S) : Teruhiko Nishiki et al.

It is certified that error appears in the above-identified patent and that said Letters Patent is hereby corrected as shown below:

Column 15,
Line 17, should read -- a compliant frame that supports a crankshaft in a radial direction, wherein the crankshaft supports the orbiting scroll in an axial direction while rotating the orbiting scroll; and --.

Signed and Sealed this

Twentieth Day of June, 2006

JON W. DUDAS
*Director of the United States Patent and Trademark Office*